United States Patent [19]

Spector

[11] 4,243,224

[45] Jan. 6, 1981

[54] SCRATCH AND SMELL PUZZLE

[76] Inventor: Donald Spector, 380 Mountain Rd., Union City, N.J. 07087

[21] Appl. No.: 68,424

[22] Filed: Aug. 21, 1979

[51] Int. Cl.[3] ..... A63F 9/10; G09B 1/06

[52] U.S. Cl. ..... 273/157 R; 434/327; 434/333

[58] Field of Search ..... 273/156, 157 R; 35/9 R, 35/73

[56] References Cited

U.S. PATENT DOCUMENTS

| | | | |
|---|---|---|---|
| 1,972,206 | 9/1934 | Thomay | 273/157 R |
| 3,570,139 | 3/1971 | Ladd et al. | 35/8 R |
| 3,627,325 | 12/1971 | Breslow | 273/295 |

FOREIGN PATENT DOCUMENTS

| | | | |
|---|---|---|---|
| 538101 | 3/1922 | France | 273/157 X |

OTHER PUBLICATIONS

Playthings Magazine, Dec. 1971, p. 43.

*Primary Examiner*—Anton O. Oechsle
*Attorney, Agent, or Firm*—Michael Ebert

[57] ABSTRACT

A game or puzzle for pre-school children which exploits both the olfactory and visual senses. The game is formed by a playing board having printed thereon at distinct positions pictures of different odoriferous objects such as fruits having characteristic smells. Superimposed on each pictured object is an identifier constituted by a major circle and a minor circle concentric therewith, the circles being radially divided into colored segments. Each identifier has a distinctive color pattern that differs from every other identifier. The periphery of the minor circle is scored to define a punchout disc, the surface of which is coated with a myriad of minute, rupturable capsules containing an odor-producing substance whose smell is the characteristic odor of the related object. The discs are removed from the playing board to create sockets therein, each of which is surrounded by a major circle ring whose color pattern matches that of the removed disc. The group of discs serve as the play elements of the game, the player being required to select a play element and to scratch and smell its surface. He then places the element in the ring socket of the pictured object which he believes gives off the same odor. The correctness of his choice is confirmed if there is a match between the color pattern of the element and that of the socket ring.

11 Claims, 6 Drawing Figures

SCRATCH AND SMELL PUZZLE

BACKGROUND OF INVENTION

This invention relates generally to a pre-school teaching device or game which exploits both the olfactory and visual senses, and more particularly to a device provided with a playing board on which is pictured a variety of objects having characteristic odors, each pictured object having a socket therein adapted to receive a smell-producing element and to visually indicate whether or not the element inserted therein gives off an odor which is that normally exuded by the related object.

Smell is that special sense which enables an individual to perceive and distinguish the odors of various substances or objects. The organ of smell is made up of olfactory cells situated in the mucous membrane of the upper portion of the nasal cavity. The hair-like free ends of the cells are stimulated by odors and scents entering the nasal cavity, the nerve fibers of the cells sending impulses through the nervous system to the brain where the odor or scent is registered.

The sense of smell in modern man has been dulled by various factors such as excessive smoking and drinking; but pre-school children remain highly responsive to odors. Taste is often confused with smell and in many instances substances supposedly tasted are without taste and are really smelled. This may account for the sharp reaction of children to unpleasant medicines which adults find less disagreeable. Yet the olfactory sensitivity of pre-school children, which is far greater than that possessed by most adults, is rarely exploited in educational or play activity.

In dealing with pre-school or primary school children there is no clear line of demarcation between play and teaching activity, for teaching is best carried out in a play or game mode. For example, in teaching a child the relationship between objects and words, one can create a game in which the child is asked to match word-bearing cards with pictures of objects. Thus in the game disclosed in the patent to Aberge et al., U.S. Pat. No. 3,172,214, the word "milk" is associated with a picture of a milk bottle, and the word "frog" with a picture of this animal.

The concept of matching underlies many of the teaching devices and games designed for pre-school children. Thus the patent to Levin, U.S. Pat. Nos. 3,349,503, matches up objects and colors. Albee, 2,659,163, matches up geometric shapes with colors; while White, 3,715,816, matches up animals with their natural food. The patent to Ladd et al., 3,570,139, discloses a book made up of sheets having coatings thereon which when scratched give off particular odors. In Ladd, after a coating is scratched and smelled, the player places a picture of a selected object such as peppermint candy against the scratched coating which the player believes gives off the odor of the object.

But lacking in the prior art is a game, puzzle or educational device in which odor, color and geometric form are coordinated in a selective matching procedure having a high degree of play and educational value.

SUMMARY OF INVENTION

In view of the foregoing, the main object of this invention is to provide a children's game or puzzle which exploits both the olfactory and visual senses and which has a high order of play and educational value, the puzzle aspects of the game serving to sustain the interest of the player.

More particularly, it is an object of this invention to provide a game in which the game board has printed thereon pictures of various objects having characteristic odors, such as prepared foods, the board being associated with a group of play elements which when scratched exude distinct odors which correspond to the respective characteristic odors of the pictured objects, the player being required to match the selected play element with the appropriate object in a manner whereby a match is visually indicated if a correct choice is made.

Also an object of the invention is to provide a game of the above type which may be manufactured at low cost.

Briefly stated, in a game in accordance with the invention, a playing board has printed thereon at distinct positions pictures of different odoriferous objects, such as fruits having characteristic smells. Superimposed on each pictured object is an identifier constituted by a major circle and a minor circle concentric therewith, the circles being radially divided into colored segments. Each identifier has a distinctive color pattern that differs from every other identifier.

The periphery of the minor circle is scored to define a punch-out disc, the surface of which is coated with a myriad of minute, rupturable capsules containing an odor-producing substance whose smell is the characteristic odor of the related object. The discs are removed from the playing board to create sockets therein, each of which is surrounded by a major circle ring whose color pattern matches that of the removed disc.

The group of discs serves as the play elements of the game, the player being required to select a play element and to scratch and smell is surface. He then places the element in the socket of the pictured object which he believes gives off the same odor. The correctness of his choice is confirmed if there is a match between the color pattern of the element and that of the socket ring.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

Figure 1:
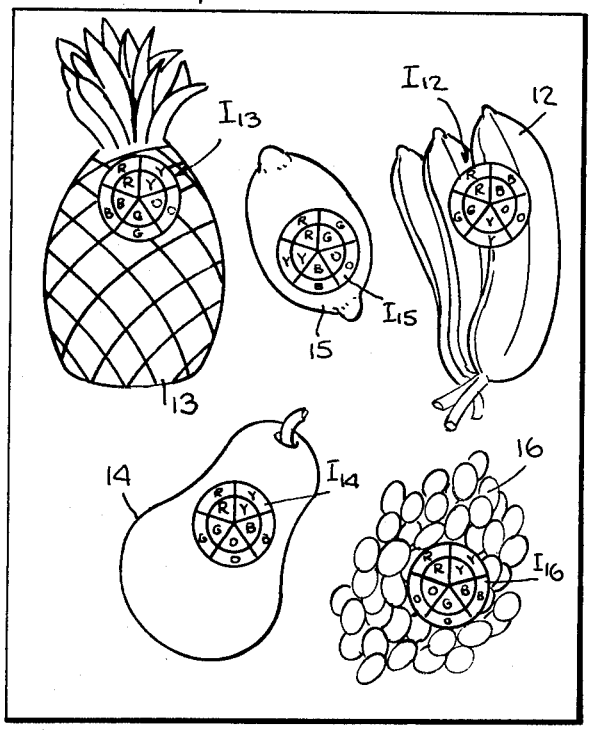
FIG. 1 illustrates a game board in accordance with the invention, with all of the playing elements socketed in place in the respective identifiers.

Referring now to FIG. 1, there is shown a playing board which may be fabricated of a panel 10 of good grade cardboard having laminated thereto a face sheet 11 of glossy printable paper. Printed on face sheet 11 at distinct positions thereon are pictures of odoriferous objects each having a characteristic smell or fragrance. In the example illustrated, these objects are fruits, such as a cluster of bananas 12, a pineapple 13, a pear 14, a lemon 15 and a bunch of grapes 16. In practice, the pictured objects may be any set of objects having characteristic odors or scents, such as different varieties of flowers, cooked foods of animals.

Superimposed over each object is a printed identifier $I_{12}$, $I_{13}$, $I_{14}$, etc. Each identifier, such as identifier $I_{12}$, is constituted by a major circle and a minor circle concentric therewith. The circles are divided by radial lines into five 65 degree segments, each printed in a different color, the color sequence being different in each identifier. Thus in identifier $I_{12}$, the color sequence in the clockwise direction is blue (B), orange (O), yellow (Y), green (G), and red (R), whereas identifier $I_{13}$, it is Y, O, G, B and R, and in identifier $I_{14}$ it is Y, B, O, G and R.

With five different colors in the sequence, a large number of permutations are possible, so that a great many objects may be pictured and identified by a distinctive color pattern, the pattern in each identifier being at variance with every other identifier.

Figure 3:
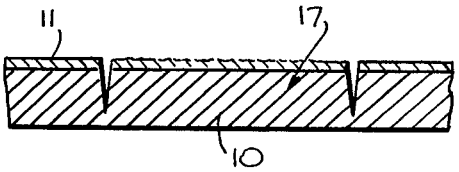
FIG. 3 is a section taken through a portion of the board.
Figure 2:
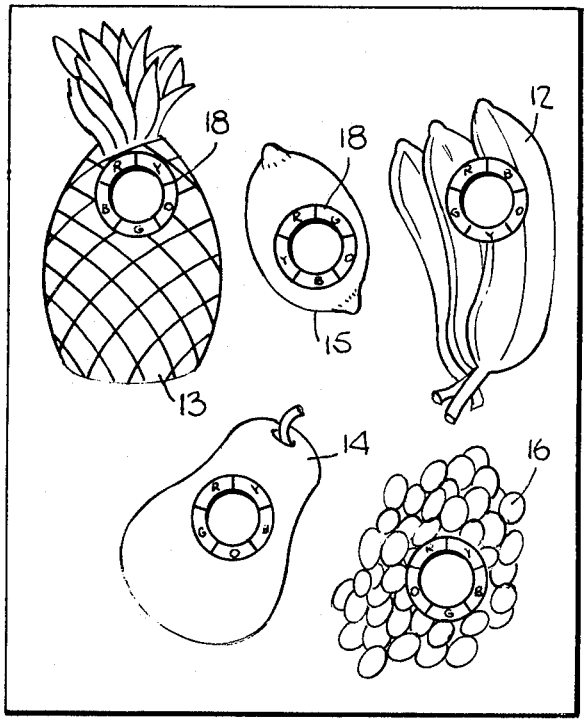
FIG. 2 shows the board with the playing elements removed from their sockets.

As best seen in FIG. 3, the periphery of the minor circle is deeply scored to define a disc 17 which may be readily punched out of the board to define a play element. When the play elements of all identifiers are removed from the board as shown in FIG. 2, this leaves at each identifier station a hole or socket surrounded by a segmented ring 18. The color sequence of the ring segments corresponds to that on the related disc 17. Hence each disc 17 will register in terms of its color pattern with only one of the socket rings 18 and no other.

The surface of disc 17 is coated with a myriad of minute, rupturable capsules filled with an odor-producing substance whose scent corresponds to or stimulates the odor of the related pictured object. Thus disc 17 in banana identifier $I_{12}$ has a coating which, when the capsules are ruptured by scratching, will exude a banana-like odor. Coatings of this type in a broad spectrum of odors which simulate virtually every known natural odor or scent are available commercially from such manufacturers as the 3M Corporation. These coatings or layers can be applied by printing techniques to the board. Because of the high density of the microscopic capsules in the coating, it may be scratched over and over again and still continue to give off the desired odor with each scratching. The game, therefore, has an almost idefinite life.

Figure 4:
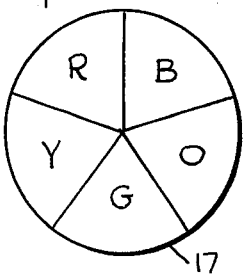
FIG. 4 illustrates one of the playing elements.
Figure 5:
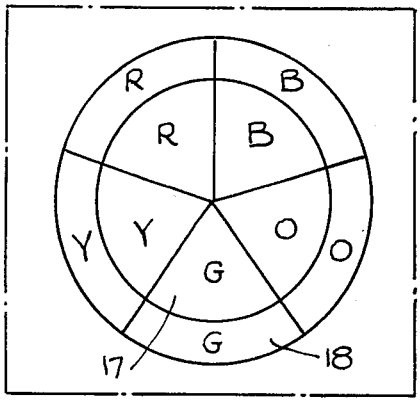
FIG. 5 shows the same playing element placed in a matching socket.

In playing the game, the player selects any one of the discs, such as disc 17 in FIG. 4, and scratches and smells its surface. From the smell the player reaches a conclusion as to which pictured object is responsible for this odor. Thus if the player receives a smell which he believes to be that of a pineapple, he places the disc into socket ring 18 of the pineapple identified $I_{13}$, as shown in FIG. 5. If, in fact, the disc gives off a pineapple odor, then the color pattern on the disc will match the color pattern of the socket ring 18 in which it is inserted; but otherwise it will not, thereby indicating to the player whether he has made a correct choice. In placing the disc in the ring socket, the player only lines up one color segment on the disc with the same color on the segmented ring; and if there is a match, all other colors will be in registration.

Figure 6:
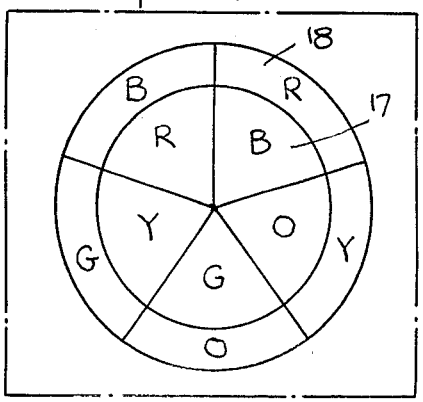
FIG. 6 shows the same playing element in an unmatched socket.

Thus FIG. 6 illustrates a mismatch of disc 17 with a socket ring 18. To complete the game, all discs must be properly inserted in their related socket rings. The game may be made competitive by distributing the discs between two players and then keeping score to see which player makes the greatest number of correct choices.

Color patterns are not the only means by which the existence of a match or mismatch may be determined. Thus instead of applying distinctive color patterns to the discs and socket rings, the discs and rings may be provided with complementary notches or coded expedients which visually indicate a match when the notches or cards on the rings and disc are in registration. Thus the playing elements may be in the form of plugs having pins in a predetermined combination which go into holes in a socket only if the socket pin holes are in registration with the plug pins.

While there has been shown and described a preferred embodiment of a scratch and smell puzzle in accordance with the invention, it will be appreciated that many changes and modifications may be made therein without, however, departing from the essential spirit thereof. Thus the playing board itself may be in the form of a jig-saw puzzle made up of separate contoured pieces which must be properly intercoupled to create the board. As a consequence, the game becomes a double puzzle, the player having to first assemble the jig-saw pieces to create a board, on which he then proceeds to play as a smell and match puzzle.

Also the invention is not limited to playing elements which require scratching to produce an odor, for it includes any treated surface which exudes a smell simulating the characteristic odor of the object to which it is related.

I claim:

1. A children's game which exploits both the olfactory and visual senses in effecting a match between a playing element and a selected object, said game comprising:

A a playing board having printed thereon at distinct positions a plurality of pictures of odoriferous objects having characteristic smells, each object having an identifier including a socket; and B a group of playing elements corresponding in number to the objects, each element having a layer thereon formed by a myriad of minute, rupturable capsules containing a substance which when the layer is scratched exudes a smell simulating the characteristic odor of a respective object, said playing element when inserted in the socket of a selected object having means to indicate whether there is a match or a mismatch between the smell from the element and the characteristic odor of the selected object.

2. A game as set forth in claim 1, wherein said playing elements are constituted by discs punched out from the identifier socket of said board.

3. A game as set forth in claim 2, wherein each identifier is superimposed on its related object and is constituted by a major circle and a concentric minor circle whose periphery is scored to permit it to be punched out of the board to form a disc serving as the playing element.

4. A game as set forth in claim 3, wherein said circles are divided radially into segments each having a different color, so that each identifier has a unique color sequence pattern.

5. A game as set forth in claim 4, wherein the circles are divided into five equal segments.

6. A game as set forth in claim 1, wherein said objects are articles of fruit.

7. A game as set forth in claim 1, wherein said objects are varieties of flowers.

8. A game as set forth in claim 1, wherein said objects are varieties of cooked foods.

9. A game as set forth in claim 1, wherein said board is formed by cardboard having a printable paper face layer laminated thereto.

10. A game as set forth in claim 1, wherein said board is constituted by jig-saw pieces which must first be assembled before the smell and match game can be played.

11. A children's game which exploits both the olfactory and visual senses in effecting a match between a playing element and a selected object, said game comprising:

A. a playing board having printed thereon at distinct positions a plurality of pictures of odoriferous objects having characteristic smells, each object having an identifier including a socket; and B. a group of playing elements corresponding in number to the objects, each element having a surface which exudes a smell simulating the characteristic odor of a respective object, said playing element when inserted in the socket of a selected object having means to indicate whether there is a match or a mismatch between the smell from the element and the characteristic odor of the selected object.

* * * * *